US006319117B1

(12) United States Patent
Moore

(10) Patent No.: US 6,319,117 B1
(45) Date of Patent: Nov. 20, 2001

(54) SCENT DISPENSER

(76) Inventor: James M. Moore, 8333 Caine Rd., Millington, MI (US) 48746

( * ) Notice: Subject to any disclaimer, the term of this patent is extended or adjusted under 35 U.S.C. 154(b) by 0 days.

(21) Appl. No.: 09/680,897

(22) Filed: Oct. 6, 2000

(51) Int. Cl.[7] ..... F24F 6/00
(52) U.S. Cl. ..... 454/328
(58) Field of Search ..... 454/328, 337, 454/291; 422/123, 124

(56) References Cited

U.S. PATENT DOCUMENTS

| | | | | |
|---|---|---|---|---|
| 81,695 | | 9/1868 | Sinclair . | |
| 526,653 | | 9/1894 | Iliowizi . | |
| 3,419,217 | | 12/1968 | White et al. . | |
| 4,067,692 | | 1/1978 | Farris . | |
| 4,654,198 | * | 3/1987 | Berardini | 454/328 |
| 4,903,584 | * | 2/1990 | Styles | 454/328 |
| 5,346,428 | | 9/1994 | Robinson, Jr. . | |
| 5,368,822 | | 11/1994 | McNeil . | |
| 5,431,859 | | 7/1995 | Tobin . | |
| 6,010,401 | | 1/2000 | Jenkins . | |

* cited by examiner

*Primary Examiner*—Harold Joyce
*Assistant Examiner*—Derek S. Boles
(74) *Attorney, Agent, or Firm*—Reising, Ethington, Barnes, Kisselle, Learman & McCulloch, P.C.

(57) ABSTRACT

The scent dispenser includes a scent adapter assembly mounted in a heating and air conditioning duct adjacent to a register. A scent dispenser housing is supported in the air duct by the adapter assembly. A scent rotor is rotatably journaled in the scent dispenser housing. A scent block is mounted in a scent holder chamber in the scent rotor. A plurality of adjustable radial apertures in the scent rotor control the passage of air through the scent rotor chamber. A housing upstream end wall of the scent dispenser housing directs air moving in the air duct toward fins on the scent rotor to rotate the scent rotor.

14 Claims, 2 Drawing Sheets

FIG-1
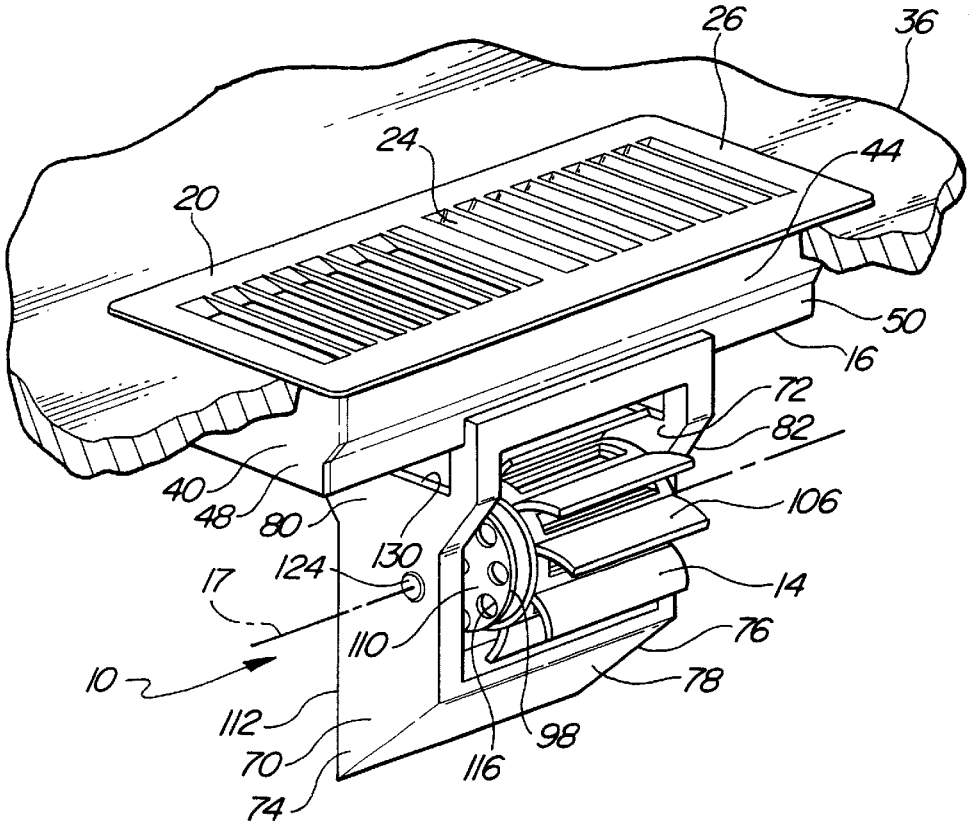
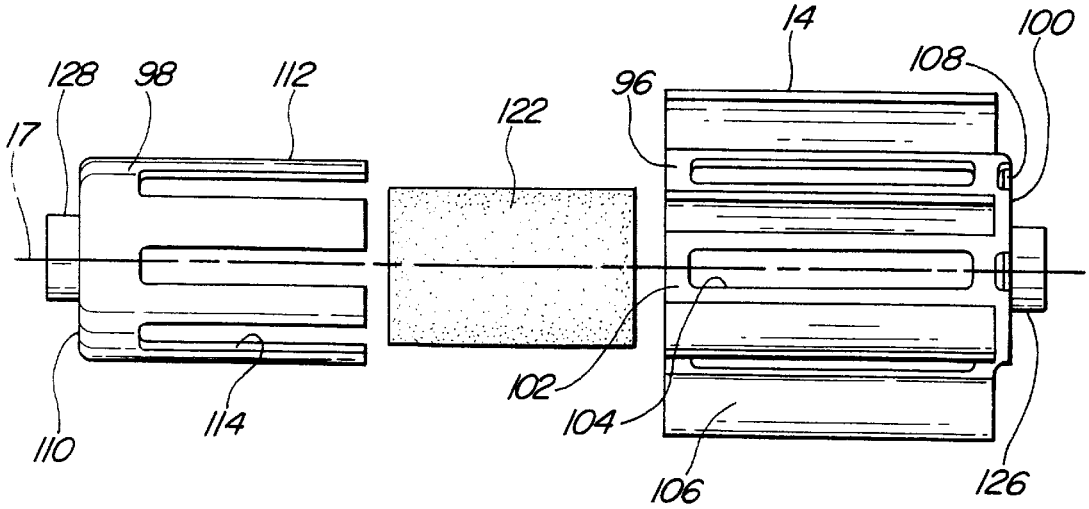
FIG-2

SCENT DISPENSER

TECHNICAL FIELD

The SCENT DISPENSER dispenses scent from a scent rotor positioned in a heating and air conditioning duct and rotated by air moving through the duct.

BACKGROUND OF THE INVENTION

Homes built today are generally relatively energy efficient. To obtain energy efficiency the homes are substantially air tight and have limited quantities of fresh air added. Scents are added to air tight homes to provide a pleasing fragrance. These scents counter act stale air and the build up of unpleasant odors.

Various types of scent dispensers are employed in homes to provide pleasant fragrances. These scent dispensers include fresh cut flowers, live plants, scented candles, scent dispensers that plug into electric outlets, materials that are heated on a stove, vaporizers with added scents, and various scent blocks that are suspended so that air can circulate around them. All of these systems for adding a pleasant fragrance to the inside of a home have some major drawbacks.

Fresh cut flowers are relatively expensive even if the homeowner grows his own. It takes time to cut them, arrange them in a vase and put water in the vase. Water may need to be added more than once a day. The scent provided by the flowers is not circulated well and is essentially non-controlled. The cut flowers remain fresh for a few days or less. At the end of their useful life they have to be disposed of and the vase should be cleaned.

Live plants provide more fragrance, and can live for at least a few months. However, most of the fragrances are provided when the plants are in bloom. Many plants bloom for a short time each year. Live plants require substantial care. Water is needed frequently. Fertilizer may be required from time to time. Insect infestations may be a problem. Dead leaves have to be removed. Some plants need direct sunlight while others need indirect light. To keep plants that have different light requirements, it is necessary to move them from time to time.

Candles can provide substantial scent when burning. The fire can be extinguished from time to time to control the scent. Candles present some risks however in that they burn and can ignite other materials. Candles also discharge an oily substance into the air that will stick to most items in a home. Cleaning a room that candles have been burned in is a taxing activity.

The scent dispensers that plug into electrical outlets take an electrical outlet out of use. They use at least some electrical energy and they rely upon natural air circulation to carry scent throughout a room. Natural air circulation is not generally satisfactory in a modern energy efficient home.

Scent dispensers that are hung where air can circulate around them work reasonably well in small closed spaces. They are frequently used in automobiles for example. When such scent dispensers are used, it takes multiple dispensers to provide fragrance throughout all but the smallest rooms. These scent dispensers tend to be unattractive. There is generally no control system to control the rate at which hanging solid block scent dispensers dispense scent.

Scent materials that are heated on a stove or that are dispensed by a vaporizer use large quantities of energy. It is relatively expensive to change a liquid to a gas by adding heat. The systems add heat and moisture to a room. Heat is unacceptable in hot weather. Moisture is unacceptable when the humidity is high and can cause substantial damage to home interiors.

Safe, inexpensive, clean and controllable scent dispensers are not currently available for home use. Most known systems for dispensing scents have one or more of the drawbacks discussed above.

SUMMARY OF THE INVENTION

The scent dispenser has a scent rotor with a scent holding chamber. The scent rotor has passages that permit air to flow through the chamber and carry scents out of the chamber. Air flow rate through the chamber is adjustable. The scent rotor is rotatably mounted in a scent dispenser housing. The scent dispenser housing is mounted in the discharge end of a heating and air conditioning duct adjacent to a register. The scent rotor is removed from the duct and scent dispenser housing without the use of tools to replace a used scent block. Air for driving the scent rotor is directed toward the rotor vanes on one side of the scent dispenser housing by an upstream housing end member.

An adapter assembly that conforms to the dimensions and construction of a register can be employed to support the scent dispenser housing in the duct. The adapter assembly can be supported in the duct by the register or by the discharge end of the duct. The adapter assembly can also be part of the dispenser housing or a separate assembly that is releasably attached to the dispenser housing.

BRIEF DESCRIPTION OF THE DRAWINGS

These and other features and advantages of the present invention will become more readily appreciated when considered in connection with the following detailed description and appended drawings, wherein:

FIG. 1 is a perspective view of the scent dispenser and a heating and air conditioning register;

FIG. 2 is an expanded elevational view of the scent rotor; and

DESCRIPTION OF THE PREFERRED EMBODIMENT

Figure 3:
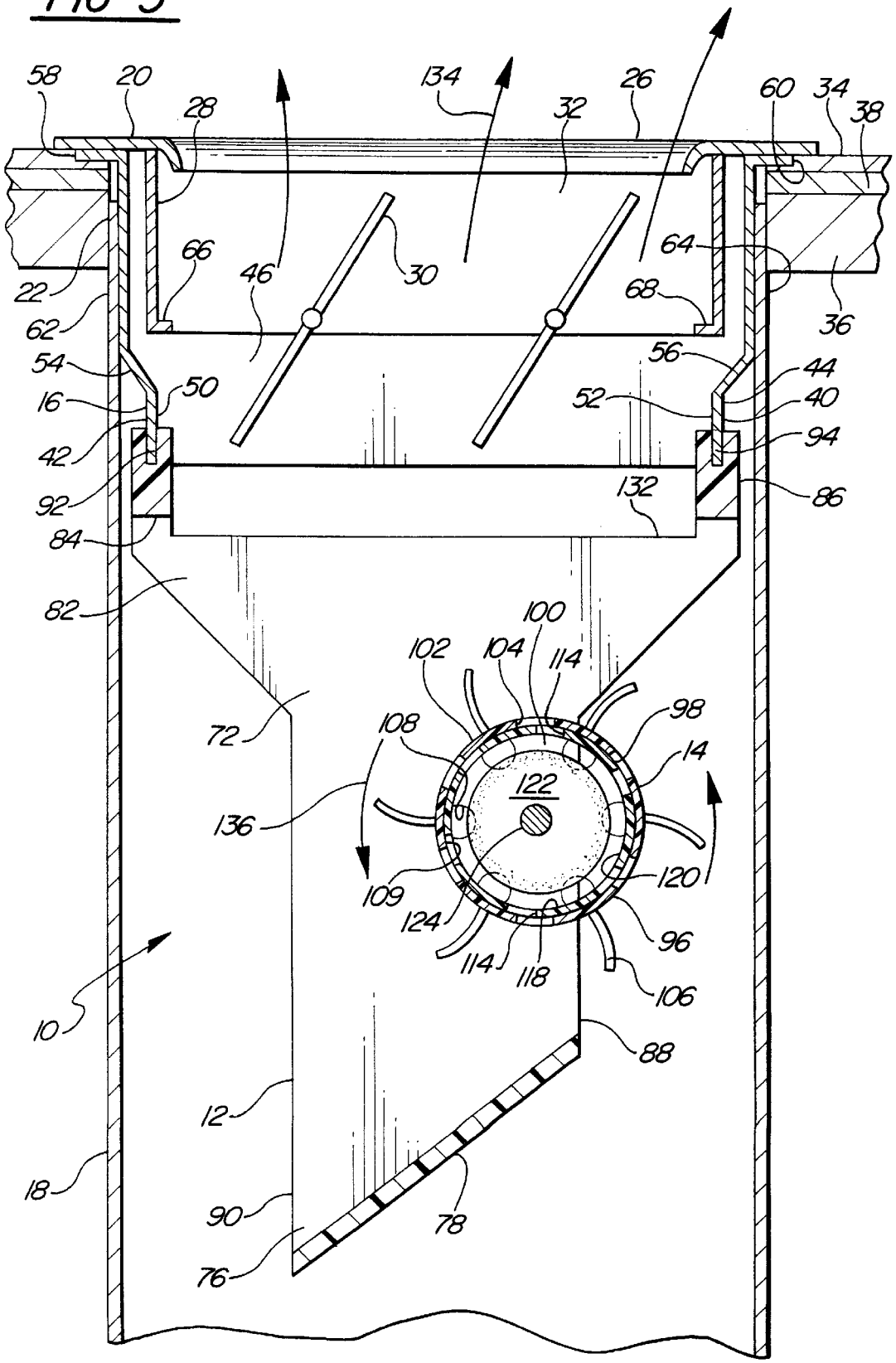
FIG. 3 is a vertical sectional view through the dispenser, the register and the heating and air conditioning duct.

The scent dispenser 10, as shown in column 1, includes a scent dispenser housing 12, a scent rotor 14 and an adapter assembly 16. The scent rotor 14 is journaled in the housing 12 for rotation about a scent rotor axis 17. The scent dispenser housing 12 is secured to the adapter assembly 16. The adapter assembly 16 fixes the position of the scent dispenser 10 inside a heating and/or air conditioning duct 18.

A register 20 covers the outlet 22 from the duct 18. The register 20 has a plurality of fixed louvers 24 and a face plate 26. A rectangular register frame 28 is attached to the bottom surface of the face plate 26 and is telescopically received in the heating and/or air conditioning duct 18. Friction normally holds the register 20 in the discharge end of the duct 18. A plurality of butterfly valves 30 are pivotally mounted in the register frame end walls 32. These plates 30 are pivoted as required to control the volume of air passing through the register 20.

The face plate 26 of the register normally sits on top of a floor covering 34 and a floor 36. The floor 36 may have multiple layers of structural material. The floor covering 34 may be carpet and a resilient carpet pad 38.

As describer above and shown in the drawing, the register 20 is mounted on the floor 36 and the air duct 18 is under the floor 36. Registers 20 are also mounted in walls and even in ceilings. When mounted in walls or in ceilings, screws are used to hold the registers 20 in place. In some heating and/or cooling systems butterfly valves (not shown) are provided in the duct 18 rather in the register 20.

Registers 20 have a number of different constructions. To accommodate these different constructions, adapter assemblies 16 are provided which accommodate the registers that are actually used. If the registers 20 had uniform sizes and construction, the adapter assembly 14 could be eliminated and the scent dispensing housing 12 could be attached directly to the register.

The adapter of assembly 16 shown in FIGS. 1 and 3 has a rectangular base 20 with side walls 42 and 44 and end walls 46 and 48. The side extensions 50 and 52 are offset at 54 and 56 and extend up adjutant to the walls 62 and 64 of the duct 18 to adapter flanges 58 and 60. The flanges 58 and 60 sit on top of the floor 36 and the floor covering 34. The flanges 58 an 60 could be attached to the face plate 26 if desired. Flanges and extensions are not provided on the end walls 46 and 48 because fit would be a problem. However, an adapter assembly 16 could be provided with extensions and flanges that are integral with end walls 46 and 48 rather than the side walls 42 and 44 if desired.

Modified adapter assemblies 16 can be attached to the rectangular register frame 28 if the register 20 will accommodate such an attachment. It may also be possible to attach an adapter assembly 16 to the bottom of the flanges 66 and 68 on the register frame 28.

A modified adapter assembly 16 can also be attach directly to the duct 18 if necessary. However it is generally not desirable to attach anything to the duct 18. Ducts 18 are generally designed and constructed for a specific instillation. The dimensions of ducts 18 which are constructed in the field vary in size making it difficult to fit an attachment such as the adapter assembly 14. It is also desirable to remove the scent dispenser 10 to place new scent producing elements in the scent rotor 14. Attachment of the scent dispenser 10 to the duct 18 may make removal difficult.

The scent dispenser housing 12 is preferably a molded plastic member. However, a number of different materials can be used to construct the housing 12. The housing has a first housing side wall 70 and a second housing side wall 72. The upstream ends 74 and 76 are connected to a housing upstream end wall 78. The downstream ends 80 and 82 of the housing side walls 70 and 72 are connected to a pair of mounting blocks 84 and 86. The first and second housing side walls 70 and 72 are parallel to each other. The scent rotor axis 17 passes through both side walls 70 and 72 at a location that is closer to the front edge 88 than the rear edge 90 of each side wall. The upstream housing end wall 78 of the housing 12 extends downstream from its rear edge 90 to its front edge 88 so that it deflects air moving downstream in the duct 18 toward the front edge of the housing. The mounting blocks 84 and 86 have slots 92 and 94. Slot 92 receives an edge of the adapter side wall 42. The slot 94 receives an edge of the adapter side wall 44. An adhesive or mechanical fasteners secure the adapter side walls 42 and 44 in the slots 92 and 94. The adapter side walls 42 and 44 are substantially longer than the housing mounting blocks 84 and 86. The housing 12 can therefore be positioned in different positions along the length of the adapter assembly 16.

The scent rotor 14 includes a first cup member 96 and a second cup member 98. The first cup 96 has a first cup end wall 100 that is concentric with and transverse to the rotor axis 17. A first cup tubular portion 102 is interracial with the end wall 100 and concentric with the rotor axis 17. A plurality of first cup apertures 104 pass through the tubular portion 102. As shown in FIG. 2 of the drawing, the apertures 104 are slots. The apertures 104 can have other shapes and can vary in size. A plurality of radially extending fins 106 are secured to the outside surface of the tubular portion 102. As shown in FIGS. 1 and 3, the fins 106 are arcuate. A plurality of first axial apertures 108 pass through the end wall 100 adjacent to an inside surface 109 of the tubular portion 102.

The second cup member 98 has a second cup end wall 110 that is concentric with and transverse to the scent rotor axis 17. A second scent cup tubular portion 112 is integral with the end wall 110 and concentric with the axis 17. A plurality of second cup apertures 114 pass through the tubular portion 112. As shown in FIGS. 2 and 3 of the drawing, the apertures 114 are slots. Like the first cup apertures 104, the second cup aperture s 114 can vary in size and shape. A plurality of second cup axial apertures 116 pass through the end wall 110 adjacent to an inside surface 118 of the tubular portion 112.

The second cup 98 is telescopically received in the first cup member 96. A scent holder chamber 120 is formed inside the scent rotor 14. A scent block 122 is mounted in the scent holder chamber 120. When the first cup apertures 104 are in radial alignment with the second cup apertures 114, air can enter the scent holder chamber 120, entrain scent from the scent block 122 and exit through the first cup axial apertures 108 and the second cup axial apertures 116. The first cup 96 is rotated relative to the second cup 98 to move the radial apertures 104 and 114 out of radial alignment with each other and reduce air flow into the chamber 120. Ideally the first and second cups 96 and 98 can be rotated relative to each other to any position between a fully closed position and a fully open position. In the fully open position, the apertures 104 are in full radial alignment with the apertures 114. In the fully closed position all of the apertures 104 are completely out of radial alignment with the apertures 114. Between the fully opened position and the fully closed position the apertures 104 are in partial alignment with the apertures 114.

The axial apertures 108 in the first cup member 96 and the axial apertures 116 in the second cup member 98, as shown in the drawing, are not closed. When the apertures 104 and 114 are closed, movement of air into the holder chamber 120 is reduced to near zero and the movement of air and scent out of the holder chamber 120 through the axial apertures 108 and 116 is near zero. A valve member is not therefor required to close the axial apertures 108 and 116. However closure members could be added to close the axial apertures 108 and 116 if desired.

Friction between a first cup 96 and a second cup 98 keeps the first cup 96 from rotating relative to the second cup 98 during operation of the scent dispenser 10. Teeth could be added to the first cup member 96 that would engage teeth on the second cup member 98 to prevent rotation of the second cup relative to the first cup.

A rotor shaft 124 passes through bores through the first and second housing side walls 70 and 72 and through bores through the first cup end wall 100 and the second cup end wall 110 to rotatably support the scent rotor 14 for rotation about the scent rotor axis 17. The rotor shaft 124 minimizes friction and permits the movement of air in the duct 18 to rotate the scent rotor 14 about the scent rotor axis 17. The scent rotor 14 can be free to rotate on the rotor shaft 124 or it c an be fixed to the rotor shaft. The rotor shaft 124 could be two separate shafts each of which supports one end of the rotor 14. The employment of two shafts leaves the scent holder chamber 120 open. The rotor shaft 124 could also be a central boss 126 on the end wall 100 and a central boss 128 on the end wall 110. The bosses 126 and 128 could be received in U-shaped boss receivers on the first and second housing side walls 70 and 72 in place of the shaft 124.

During operation of the scent dispenser 10, one or more scent blocks 122 are inserted into the scent holder chamber 120. As shown, the scent block 122 is a cylindrical member with a central aperture. The scent block 122 can take a number of different shapes other than cylindrical. The scent block 122, for example, could be one or more plastic bags filled with a jell that passes through the plastic bags. Scent material holders can be formed in the second cup member 98 if required to insure that air flows through the chamber 120 and that the second cup apertures 114 are not blocked. After the scent block 122 is inserted into one end of the scent holder chamber 120, the second cup tubular portion 112 is telescopically inserted into the first cup tubular portion 120. The first cup member 96 is rotated relative to the second cup member 98 to open the first cup apertures 104 and the second cup apertures 114 and obtain the desired air flow through the scent holder chamber 120. The rotor 14 is then rotatably mounted in the scent dispenser housing 12.

The scent dispenser housing 12 is then positioned in the duct 18. Ducts 18 often have elbows adjacent to the register 20. To accommodate the small space provided by some elbow s and ducts 18 it is necessary to place the scent rotor 14 as close to the register 20 as possible. Recesses 130 and 132 in the dispenser housing 12 permit the scent rotor 14 to be moved toward the register 20 without blocking the butterfly plates 30. Mounting the housing 12 and the duct 18 includes attaching the scent dispenser housing 12 to the adapter assembly 16 if an adapter assembly is employed. The adapter assembly 16 and the scent dispenser assembly 12 are connected to the register 20 or to the outlet end 22 of the duct 18 and the floor 36. Air passing downstream through the duct 18 as indicated by the arrows 134 is deflected by the housing upstream end wall 78 toward the front edge 88 of the housing 12. The fins 106 of the scent rotor 14 extend outwardly into the air stream that has been deflected by the housing end 78. The force exerted on the fins 106 by the moving air causes the scent rotor to rotate about the scent rotor axis 17 in the direction indicated by the arrows 136. The fins 106 with their arcuate shape also deflect a portion of the moving air toward the first and second cup apertures 104 and 114 and into the scent holder chamber 120. Air passing into the scent holder chamber 120 entrains scent vapors from the scent block 122. The air and entrained scent vapors exit the scent holder chamber 120 through the first and second cup axial apertures 108 and 116. After passing through the axial apertures 108 and 116, the air and entrained scent passes downstream and through the register 20.

The length of the scent dispenser housing 12 from the first housing side wall 70 to the second housing side wall 72 is substantially less than the length of the register 20. A substantial portion of the air passing out of the duct 18 and through the register 20 therefore bypasses the scent dispenser 10. The scent dispenser 10 as shown in the drawing, minimizes the disruption of air flow through the register 20.

The temperature of air passing through the duct 20 varies substantially from the summer cooling season to the winter heating season. Hot air picks up substantially more scent than colder air. There is therefore a need to adjust the quantity of air passing through the scent holding chamber 120 from summer to winter. There may also be a need to adjust the air flow rate through the scent holder chamber 120 in the fall and spring when the furnace and air conditioner operate less frequently and total air flow through the duct per day is decreased.

Obviously, many modifications and variation of the present invention are possible in light of the above teachings. It is, therefore, to be understood that within the scope of the appended claims, the invention may be practiced otherwise than as specifically described. The invention is defined by the claims.

What is claimed is:

1. A scent dispenser comprising:

a scent rotor having a scent rotor axis, a scent chamber for holding a scent block, a plurality of radially extending fins fixed to an outer surface of the scent chamber, apertures through the scent chamber for the passage of air through the scent chamber;

a scent dispenser housing rotatably supporting the scent rotor, for rotation about said scent rotor axis, and wherein the scent dispenser housing is mounted in a fixed position within an air duct and has a housing end wall that directs air moving in the duct toward the plurality of radially extending fins to rotate the scent rotor.

2. A dispenser as set forth in claim 1 wherein the apertures through the scent chamber are adjustable to adjust air flow through the scent chamber.

3. A scent dispenser as set forth in claim 1 wherein the scent chamber is openable to insert a new scent block into the scent chamber.

4. A scent dispenser as set forth in claim 1 wherein the scent dispenser housing is attached to a duct register on a discharge end of the air duct.

5. A scent dispenser as set forth in claim 1 wherein the scent dispenser is attached to an air duct discharge end.

6. A scent dispenser as set forth in claim 1 including an adapter assembly that is mounted in an air duct discharge end and supports the scent dispenser housing.

7. A scent dispenser as set forth in claim 6 wherein the adapter assembly is attached to a duct register.

8. A scent dispenser comprising:

a scent rotor having a scent rotor axis, a first cup member having a first cup end wall that is concentric with and transverse to said scent rotor axis, a first cup tubular portion that is integral with the first cup end wall and concentric with said rotor axis, a plurality of first cup apertures in the first cup tubular portion and a plurality of radially extending fins on an outer surface of the first cup tubular portion, a second cup member having a second cup end wall that is concentric with and transverse to said scent rotor axis, a second cup tubular portion that is integral with the second cup end wall and concentric with said rotor axis, a plurality of second cup apertures in the second cup tubular portion and wherein the second cup member is telescopically received in the first cup member to form a scent holder chamber and the plurality of second cup apertures are movable into and out of radial registration with the plurality of first cup apertures to control the movement of air into and out of the scent holder chamber;

a scent dispenser housing including a first housing side wall, a second housing side wall that is spaced from the first housing side wall, an upstream housing end, a downstream housing end, a housing back side, a housing front side, a housing upstream end wall that is integral with the first housing side wall and the second housing side wall and inclined from the housing back side to the housing front side toward the downstream housing end to defect air toward the housing front side and wherein the scent rotor is rotatably supported, for rotation about said scent rotor axis, by the first housing side wall and the second housing side wall adjacent to the housing upstream end wall, and with the plurality of radially extending fins moving into and out of positions on the front side of the housing upstream end wall during rotation of the scent rotor; and an adapter assembly connected to the scent dispenser housing and holding the scent dispenser housing in a stream of moving air.

9. A scent dispenser as set forth in claim 8 including a plurality of first cup axial apertures through the first cup end wall and a plurality of second cup axial apertures through the second cup end wall.

10. A scent dispenser as set forth in claim 8 wherein the adapter assembly is connected to a duct register.

11. A scent dispenser as set forth in claim 10 wherein the adapter assembly is part of the scent dispenser housing.

12. A scent dispenser as set forth in claim 8 wherein the adapter assembly is connected to an outlet end of a duct and to a floor that supports the outlet end.

13. A scent dispenser as set forth in claim 12 wherein the adapter assembly is part of the scent dispenser housing.

14. A scent dispenser as set forth in claim 8 including a rotor shaft passing through the scent dispenser housing and the scent rotor to rotatably support the scent rotor.

* * * * *